United States Patent [19]

Zaninovich et al.

[11] 4,005,670

[45] Feb. 1, 1977

[54] PASSIVE STABILIZATION SYSTEM FOR SHIPS

[75] Inventors: John Zaninovich, Chula Vista; Ante Stipich, San Diego, both of Calif.

[73] Assignee: Campbell Industries, San Diego, Calif.

[22] Filed: Feb. 1, 1971

[21] Appl. No.: 111,207

[52] U.S. Cl. ..... 114/125

[51] Int. Cl.[2] ..... B63B 43/06

[58] Field of Search ..... 114/125, .5 R

[56] References Cited

UNITED STATES PATENTS

| | | | |
|---|---|---|---|
| 3,192,888 | 7/1965 | Field | 114/125 |
| 3,228,368 | 1/1966 | Deal | 114/125 |
| 3,272,170 | 9/1966 | Dreyfus | 114/125 |
| 3,678,877 | 7/1972 | Csupor | 114/125 |

FOREIGN PATENTS OR APPLICATIONS

| | | | |
|---|---|---|---|
| 750,660 | 6/1956 | United Kingdom | 114/125 |

*Primary Examiner*—Trygve M. Blix
*Assistant Examiner*—Charles E. Frankfort
*Attorney, Agent, or Firm*—Brown & Martin

[57] ABSTRACT

A stabilization system for ships having two tanks for the storage of liquid connected by a cross-over duct. The tanks are located close to one another on either side of the fore and aft center line of the ship. The cross-over ducts are spaced from the bottom of the tanks so that only a portion of the liquid in the tanks moves from one tank to the other during rolling of the ship. The ducts contain valves which can be used to tune the system or to shut it down.

8 Claims, 4 Drawing Figures

Fig. 1

INVENTORS
JOHN ZANINOVICH
ANTE STIPICH
BY
Brown & Martin
ATTORNEYS

INVENTORS
JOHN ZANINOVICH
ANTE STIPICH
BY
Brown & Martin
ATTORNEYS

PASSIVE STABILIZATION SYSTEM FOR SHIPS

BACKGROUND OF THE INVENTION

Many devices have been proposed for stabilizing ships. Of the six degrees of freedom possessed by a ship, the stabilizing of ships in roll has most often been attempted since this motion is both directly related to passenger comfort, safety of operation of a working ship in the open sea and cargo security and in addition requires relatively low forces to achieve stabilization.

In some vessels movable fins have been employed to stabilize the ship in roll, however, these devices are complex requiring gyroscopic control and require extensive maintenance. Further these devices detract from the ships speed performance since they represent a considerable area protruding into the water. These characteristics together with the high cost involved make fin stabilizers unsuitable, particularly for smaller ships.

Tank stabilizers, particularly passive tank stabilizers, have obvious advantages in terms of simplicity in installation and maintenance. However, prior art tank stabilizers have either been suitable in configuration for use with many ships, produced excessive noise during operation, or have been insufficiently responsive to achieve sufficient stabilization. Further, prior art tank stabilizers have required the dedication of an excessively large portion of the ship's usable volume to the stabilizing device.

Thus it would be desirable if a simple tank stabilizer could be developed which had a high degree of flexibility in its placement and utilization and was more responsive to the rolling of the ship and achieved placement at the most effective location.

SUMMARY OF THE INVENTION

An exemplary embodiment of the invention comprises two stabilization tanks mounted in a fishing vessel. The tanks are designed to be dual purpose, that is, they may be used for the storage of liquid or purposes other than roll stabilization. For example, in the instant embodiment, the tanks may serve as refrigerated fish storage. The tanks extend in height from the double bottom all the way to deck level and beamwise extend almost the entire width of the ship being separated only by that distance necessary to accommodate the requirement for a fore and aft passageway, such as a pipe alley. Thus the tanks are of a design which take the full advantage of the space available while accommodating themselves to the necessities of ship design. The tanks are interconnected by a duct or ducts of sufficient cross sectional area to permit adequate flow of water. The cross sectional area of these ducts for a particular ship is determined from well known formula. The ducts are placed well above the bottom of the tanks selected, and in the instant embodiment are located at the approximate mid-point of the height of the tanks. Included within the ducts are gate valves for throttling or completely shutting off the flow through the ducts.

Both tanks are vented at their top sides to the atmosphere. In the instant embodiment, these vents take the form of hatches which may be opened to permit the free flow of air into and out of the tanks as the water level changes with rolling. The water level is maintained at all times at a height sufficient to maintain the ducts full of water despite the rolling of the ship and the consequent movement of water from tank to tank.

Screens are provided on either side of the ducts to prevent entry to the ducts of solid material, such as fish, and in the instant embodiment, these screens comprise the refrigeration tubing which screen the ducts as it courses back and forth across the tank face.

In operation the hatch vents are opened and the gate valve opened, for example, to its full open position. As the ship rolls there is a tendency for the water to flow to the low side. However, because of the restricted throttling effect of the ducts, most of the water arrives at the low side after that side has begun to roll to the opposite direction. Thus there is a greater amount of water in the tank on the side of the ship which is rolling toward a higher position and the rolling of the ship is thereby resisted, reducing the total roll. The throttling ducts function as a means for placing the moving water 90° out of phase with the rolling ship.

The effectiveness of any stabilization tank is dependent upon the height of the mass of moving water relative to the roll axis of the ship. Further, the stabilization systems effectiveness is dependent upon its ability to follow varying sea states and induced roll rates. The invention has a maximum effectiveness with regard to both of these requirements, by utilizing as its moving volume the required mass of water in the top portion of the tanks only, and by utilizing closely spaced tanks that result in a short duct length and therefore low duct friction. The venting of the tanks to the atmosphere eliminates the requirement for a interconnecting air duct and its attendant noise producing throttling valve. Any adjustments necessary to the system to accommodate variations aboard a particular ship are made through the use of the valves in the ducts or the height of water in the tanks.

The placement of the duct is advantageous in that it permits piping and other services located fore and aft through the pipe alley in the ship, to be accommodated without compromise in the stabilizer design and further permits the use of tanks which contain a volume in excess of that required for stabilization.

It is therefore an object of this invention to provide a new and improved passive tank stabilization system for ships.

It is another object of the invention to provide a new and improved passive tank stabilization system which is compatible for a dual use for the tanks employed.

It is another object of the invention to provide a new and improved passive stabilization system which employs two closely spaced tanks.

It is another object of the invention to provide a new and improved stabilization system which is simple in design and permits more flexibility in the placement of the tanks and interconnecting ducts.

It is another object of the invention to provide a new and improved passive stabilization system in which solid materials are prevented from moving from one tank to another.

It is another object of the invention to provide a new and improved passive stabilization system in which the tanks are vented to the atmosphere.

It is another object of the invention to provide a new and improved passive tank stabilization system in which only a portion of the liquid volume within the tanks is utilized for stabilization.

It is another object of the invention to provide a new and improved passive tank stabilization system which is adjustable to provide for variation in the stabilization requirements.

It is another object of the invention to provide a new and improved passive tank stabilization system which accommodates a dual purpose for the liquid employed.

Other objects and many attendant advantages will be obvious upon a reading of the following detailed description and an examination of the drawings wherein like reference numerals designate like parts throughout and in which.

Figure 1:
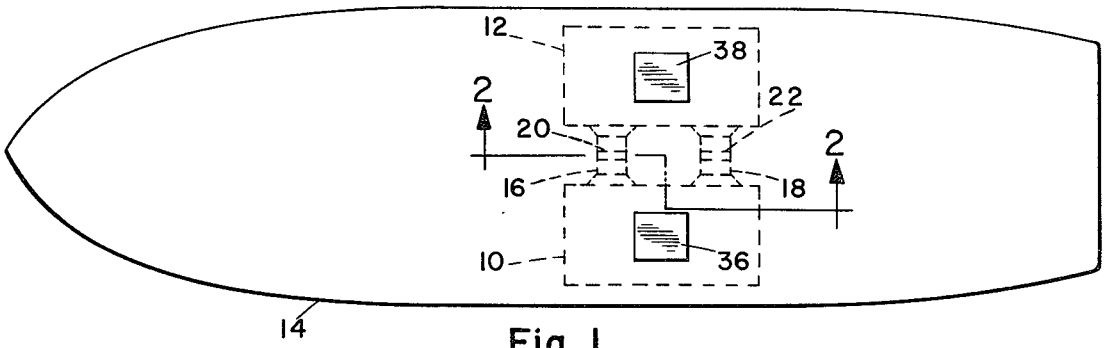
FIG. 1 is a top plan view of a typical vessel, showing the tank arrangement.
Figure 2:
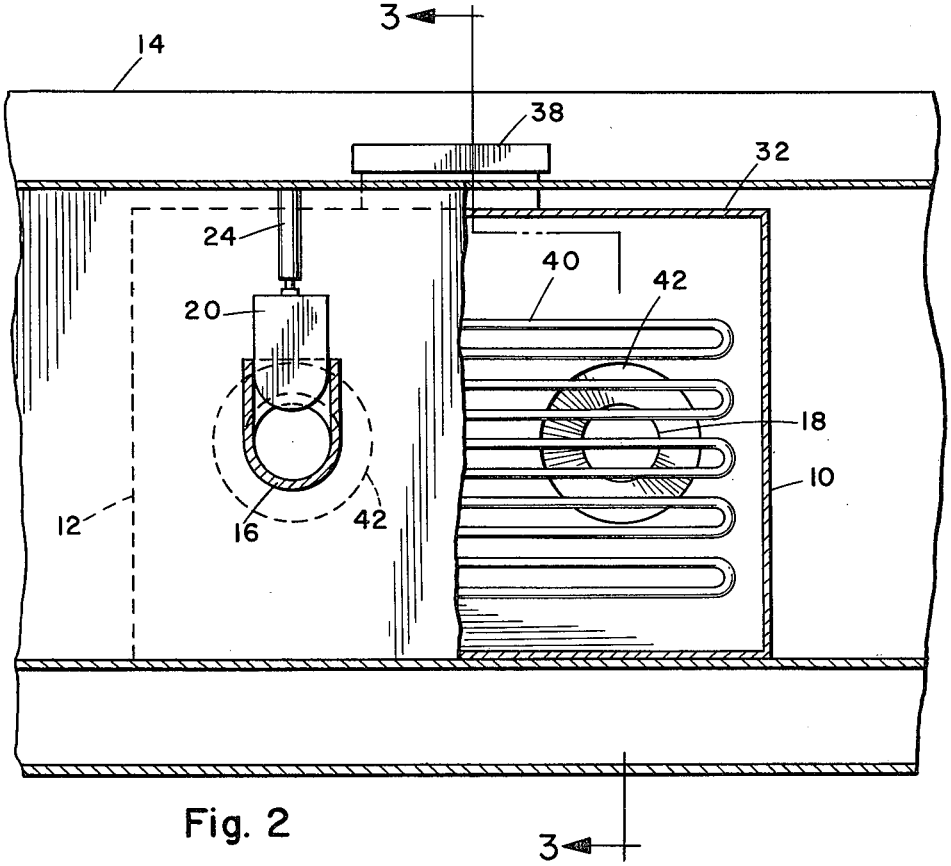
FIG. 2 is an enlarged sectional view taken on line 2—2 of FIG. 1.
Figure 3:
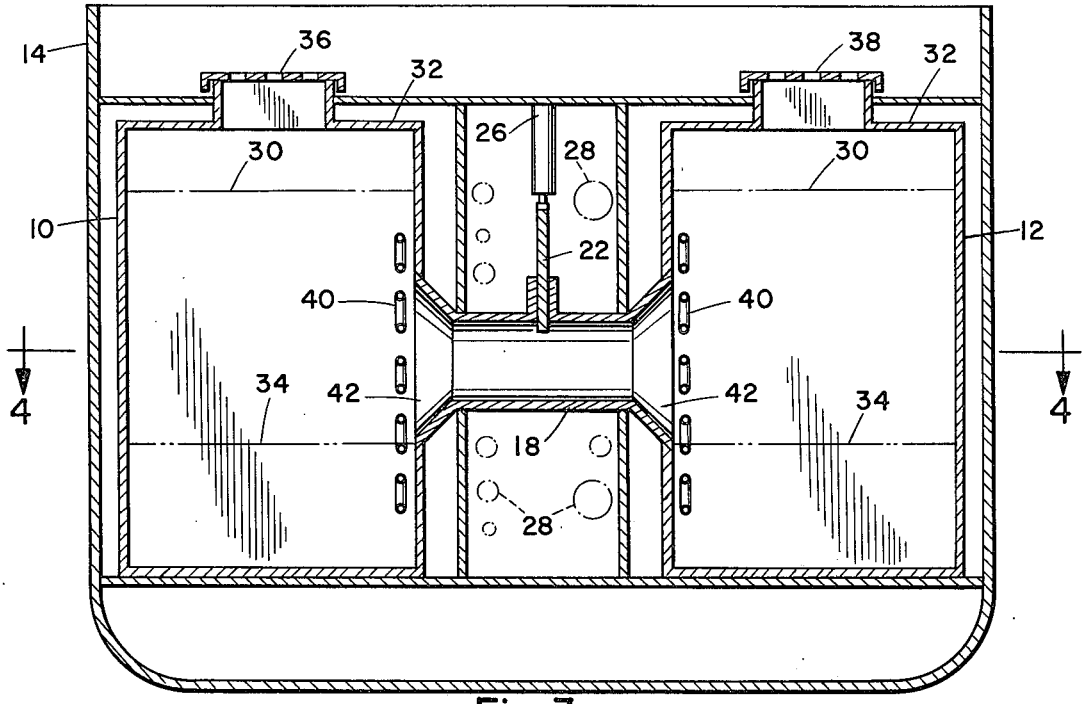
FIG. 3 is a sectional view taken on line 3—3 of FIG. 2.
Figure 4:
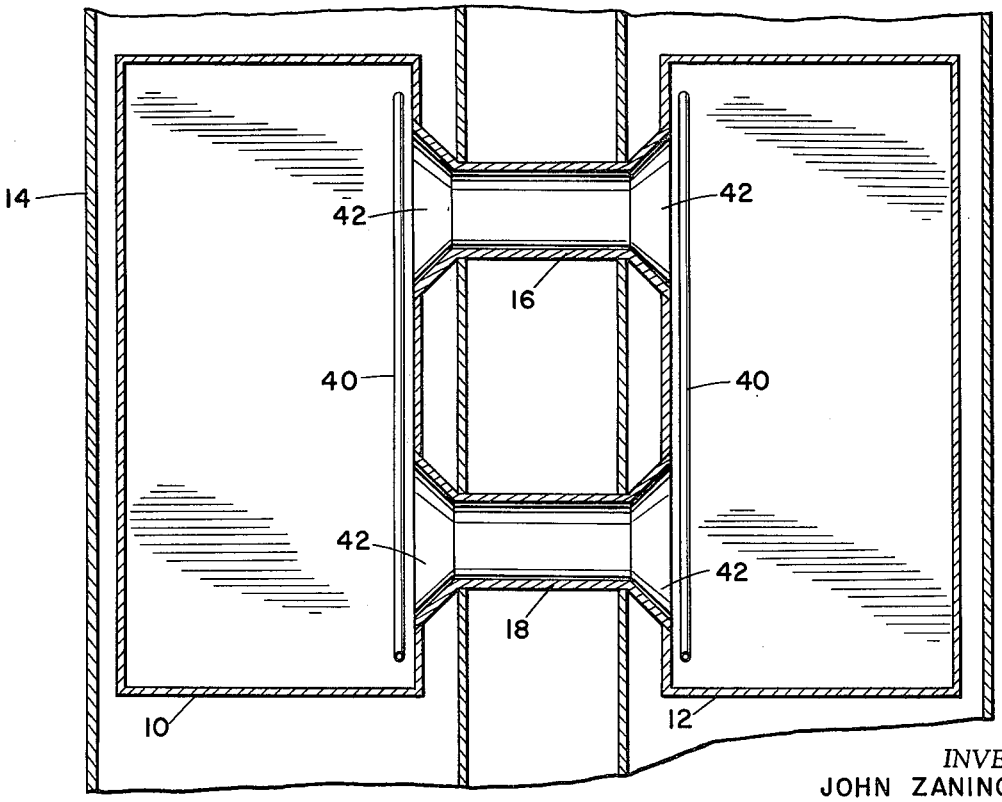
FIG. 4 is a sectional view taken on line 4—4 of FIG. 3.

Referring now to the figures, there are illustrated tanks 10 and 12 mounted in a ship 14. The tanks are shown to be interconnected by dual ducts 16 and 18. The ducts contain gate valves 20 and 22 respectively. The gate valves are operated by actuators 24 and 26. The tanks are shown to be spaced from one another by a distance which is less than the beamwise width of either tank. The space between the tanks comprises a pipe alley carrying ships services fore and aft within the ship including a plurality of pipes 28.

The water is maintained at a level 30 which is well above the level of the top of the ducts 16 and 18 yet considerably below the top of the tank 32. In this manner sufficient room is provided for the water to pass between the tanks 10 and 12 without overflow and with the ducts being maintained full at all times. For a given angle of maximum roll there will be a volume of water located below the level of the bottom of the ducts and indicated for exemplary purposes by the broken line 34, which volume will not move from one tank to the other. This volume of water is determined by the placement of the ducts along the vertical extent of the tanks and thus placement of the ducts may determine the moving mass of the water utilized. Tank 10 contains one or more hatch type vents 36 located at its upper side and tank 12 contains similar hatch vents 38. These vents are of sufficient area to allow free flow of air in and out of tanks in response to the movement of water between the tanks. Since the movement of air is relatively unrestrained, it produces little or no noise during the operation of the system and has little or no damping effect.

In the instant embodiment, the tanks are utilized for the additional purpose of the cold storage of fish. The tanks would normally be filled with fish last so as to allow their unrestricted use as stabilizers. However it is possible to use the tanks with the fish carried in the tanks with the movement of the fish from one tank to the other being restrained by a screen effect over the openings to the ducts. This screening may most advantageously take the form of the refrigeration piping 40 which criss-crosses the surface of the tanks and passes across the ducts.

Since the system can produce relatively high flow rates between the tanks, cavitation would be a problem if provision were not made for slowing the localized flow. For this reason the ducts each contain an intermediate section 42 adjacent their opening to the tank which diverges from the center section at 45° so as to provide for a freer flow of water and to reduce the possibility of cavitation damage.

In operation, the system will be filled to a liquid level 30 which corresponds to the theoretical level for the system determined in accordance with well known mathematical techniques to produce the maximum damping action for a given sea condition. The sea condition normally utilized for this calculation is that having a wave period which corresponds the natural period of roll for the particular ship. This represents the worst condition, in that waves of this type roll the ship at its resonant frequency and therefore tend to produce maximum roll deviations. The liquid level, however, is never susceptible to precise determination for a particular ship since many variables may accumulate to produce an error. Further, the natural period for the ship varies with the loading conditions and in particular on a fishing vessel may change considerably between the conditions with all tanks empty or in a minimum ballast condition and that with all tanks full. To compensate for these variables, the liquid level may be adjusted by adding or pumping out liquid until the best damping action for the particular ship loading condition is achieved. Further adjustment under way may be easily achieved to compensate for example, for varying sea states, by partially closing the gate valve. This has the effect of reducing the mass of water which transfers from one tank to the other and also reduces the system's ability to follow high frequency induced roll rates. Thus partial closing of the valves would be employed to adjust the system for sea states less than the worst condition previously described.

With the system adjusted and the vents opened, no further attention is necessary to the systems operation. As the ship rolls, water passes through the ducts from one tank to another and the relatively restricted area of the ducts, as compared to the volume of water, damps the waters movement so it cannot follow the roll of the ship and in fact, is approximately 90° out of phase with the ships roll. This damping action places a greater mass of water on the side of the ship which tends to oppose the roll of the ship in that direction and thereby reduces the total angle of roll produced.

When it is necessary to place fish or other solid material within the tanks the stabilization system may still be utilized by virtue of the screening effect provided in the instant invention by the refrigeration piping criss-crossing the duct areas. This screening prevents the fish from being damaged by passage through the narrow duct area from one tank to another and further prevents them from impeding the action of the gate valves. If desired, all movement of water from one tank to the other may be prevented by closing the gate valves, thereby preventing any damage to the fish which might be occasioned by the impact of the fish with the screen.

Having described my invention, I now claim:

1. A stabilization system for a ship comprising:

at least two tanks means for the storage of liquid, cross over means comprising an enclosed duct means connecting said tank means below the tops thereof, for transferring water between said tank means during rolling of said ship, said tank means being located on either side of the fore and aft center line of said ship, said tank means being spaced from one another by a distance less than the beam-wise width of a single one of said tank means, said cross over means is effective for permitting only a portion of said liquid to move from one tank means to another during rolling of said ship, and said enclosed duct means is spaced from the bottom of said tank means.

2. The stabilization system of claim 1 wherein:

a substantial proportion of said liquid is below the level of said enclosed duct means.

3. The stabilization system of claim 2 wherein:

said tank means are vented to the atmosphere.

4. The stabilization system of claim 1 wherein:

said enclosed duct means comprises two ducts of circular cross-section mounted at the same height above the bottom of said tank means.

5. The stabilization system of claim 4 wherein:

the end portions of each of said ducts diverges at approximately a 45° angle spaced from the opening to said tank means.

6. The stabilization system of claim 1 wherein:

said enclosed duct means has a gate valve mounted between its ends.

7. The stabilization system of claim 6 including:

screen means for preventing solid material from passing through said enclosed duct means and valve.

8. The stabilization system of claim 1 wherein:

said liquid is maintained at a level which fully covers said enclosed duct means at all times despite the rolling of said ship.

* * * * *